United States Patent [19]

Kasama

[11] Patent Number: 4,803,752

[45] Date of Patent: Feb. 14, 1989

[54] CLEANING DEVICE

[75] Inventor: Nobuhiro Kasama, Yokohama, Japan

[73] Assignee: Canon Kabushiki Kaisha, Tokyo, Japan

[21] Appl. No.: 906,577

[22] Filed: Sep. 9, 1986

Related U.S. Application Data

[63] Continuation of Ser. No. 523,145, Aug. 15, 1983.

[30] Foreign Application Priority Data

Aug. 23, 1982 [JP] Japan ..... 57-145806

[51] Int. Cl.[4] ..... G03G 21/00

[52] U.S. Cl. ..... 15/256.51; 101/169; 118/652; 15/245

[58] Field of Search ..... 15/256.51, 245; 118/652, 261, 126; 101/169; 68/202, 203

[56] References Cited

U.S. PATENT DOCUMENTS

| | | | |
|---|---|---|---|
| 1,351,862 | 9/1920 | Menkhaus | 15/245 |
| 1,993,352 | 3/1935 | Schwartz | 15/256.51 |
| 2,008,221 | 7/1935 | Molander | 15/245 |
| 2,032,626 | 3/1936 | Moller | 15/245 |
| 2,418,706 | 4/1947 | Goyette | 15/256.51 |
| 2,477,339 | 7/1949 | Ljungquist | 15/256.51 |
| 2,487,409 | 11/1949 | Baker | 15/256.51 |
| 2,815,524 | 12/1957 | Mitchell | 15/256.51 |
| 3,085,275 | 4/1963 | Allison | 15/256.51 |
| 3,649,991 | 3/1972 | Grimston et al. | 15/256.51 |
| 3,866,266 | 2/1975 | Dunlap | 15/256.51 |
| 4,083,633 | 4/1978 | Shanly | 15/245 X |
| 4,334,766 | 6/1982 | Sugiyama | 15/256.51 |
| 4,359,799 | 11/1982 | Boose | 15/256.51 |

*Primary Examiner*—Harvey C. Hornsby
*Assistant Examiner*—Frankie L. Stinson
*Attorney, Agent, or Firm*—Fitzpatrick, Cella, Harper & Scinto

[57] ABSTRACT

This specification discloses a cleaning device for removing residual developer or the like on an image bearing member. More particularly, it discloses a cleaning device in which a cleaning blade is sandwiched between sandwiching members and the cleaning blade and the sandwiching members are coupled together by a tightening force. The buffer portions for buffering the propagation of the tightening force to the blade are provided in the sandwiching members.

29 Claims, 3 Drawing Sheets

CLEANING DEVICE

This application is a continuation-in-part of application Ser. No. 523,145 filed Aug. 15, 1983 now abandoned.

BACKGROUND OF THE INVENTION

1. Field of the Invention

This invention relates to a cleaning device for use in an image forming apparatus such as a copying apparatus, a laser beam printer or a micro instrument, and particularly to a cleaning device in which a cleaning blade is sandwiched between sandwiching members and the cleaning blade and the sandwiching members are coupled together by the tightening force of screws or the like.

2. Description of the Prior Art

Description will hereinafter be made by taking as an example a cleaning device used in an electrophotographic copying apparatus.

In various types of image forming apparatus wherein a developed image is formed on an image bearing member such as an electrophotographic photosensitive member or the like and transferred to a transfer medium, an elastic cleaning blade has been widely used as a device for cleaning the image bearing member after the image transfer.

In such blade type cleaning device, the elastic cleaning blade is sandwiched by a holder provided with sandwiching members such as iron plates and this is mounted to the body of a copying apparatus or the like, whereby cleaning is effected.

Now, when the cleaning blade is sandwiched between the sandwiching members such as iron plates, it has been practised to apply the sandwiching members to the front and back sides of the blade and tightening these three members at a plurality of locations by the use of screws, thereby coupling them together.

This system has the advantages that reliable coupling can be easily accomplished and that replacement of the blade can be readily accomplished.

However, the tightening force is provided from the tightened point of the sandwiching members and therefore, where the sandwiching members are not of a sufficient thickness and strength or where the distance from the tightened point to the portion sandwiching the elastic cleaning blade is short, the elastic cleaning blade is sometimes sandwiched in its waving condition. This may cause unsatisfactory cleaning or rapid loss of the blade. For this reason, in the conventional devices, the sandwiching members such as iron plates have been made to have a sufficient thickness and size. Further, in some cases, it has been necessary to provide the simple plate-like members with a complicated reinforcing portion.

Such conventional construction has been a hindrance to compactness and light weight of the cleaning device and further, of the image forming apparatus.

SUMMARY OF THE INVENTION

It is an object of the present invention to provide a cleaning device which can readily be made light in weight and compact.

It is another object of the present invention to provide a cleaning device in which the strength of sandwiching members is not so much required as in the conventional device.

It is still another object of the present invention to provide a cleaning device which does not require a special reinforcing member for preventing the waving of the blade.

The invention will become fully apparent from the following detailed description thereof taken in conjunction with the accompanying drawings.

DESCRIPTION OF THE PREFERRED EMBODIMENTS

Figure 1:
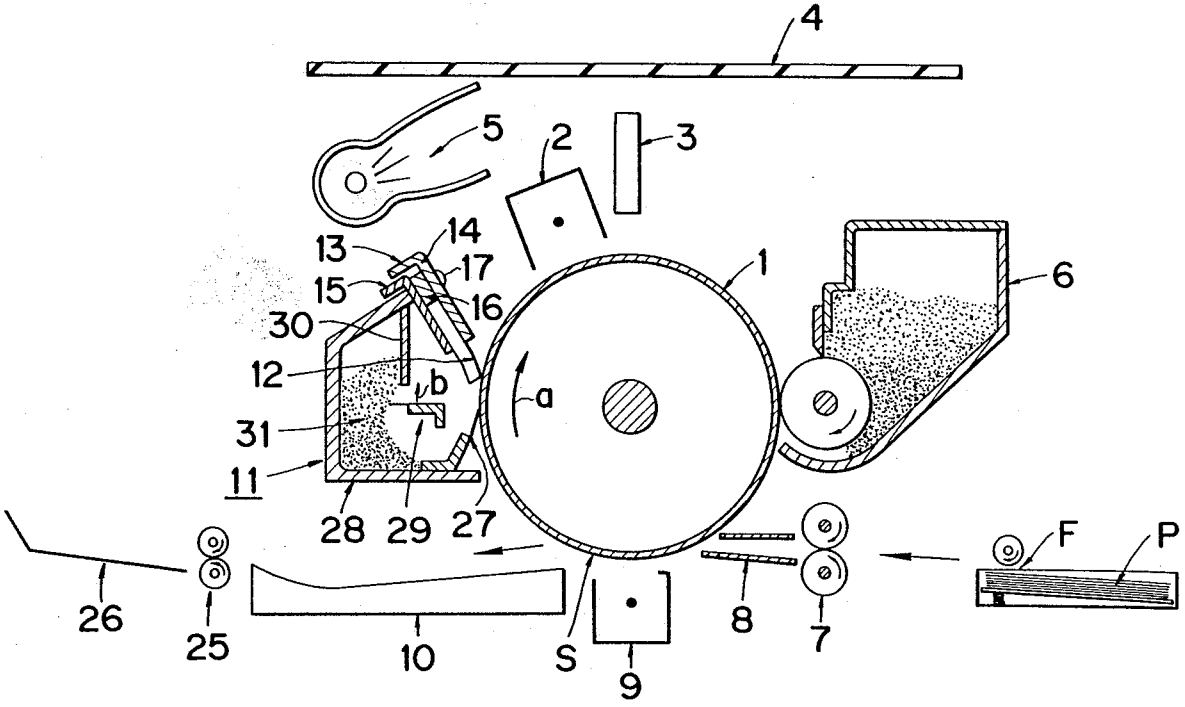
FIG. 1 schematically shows a copying apparatus provided with a cleaning device to which an embodiment of the present invention is applied.

FIG. 1 illustrates a copying apparatus which is an example of the image forming apparatus to which the cleaning device of the present invention is applied.

In FIG. 1, reference numeral 1 designates an image bearing member comprising a photosensitive medium having a photoconductive substance such as Se or OPC and supported in the form of a drum.

The image bearing member 1 is rotated in the direction of arrow a by drive means, not shown. Reference numeral 2 denotes a corona discharger and reference numeral 3 designates a small-diameter imaging element array. Reference numeral 4 denotes an original carriage and reference numeral 5 designates an illuminating light source. Reference numeral 6 denotes a developing device, reference numeral 7 designates timing rollers and reference numeral 8 denotes a transfer medium guide. Reference numeral 9 designates a transfer corona discharger and reference numeral 10 denotes a transfer medium conveyance path. Reference numeral 11 designates a cleaning device according to the present invention, reference numeral 12 denotes an elastic cleaning blade and reference numeral 13 designates a blade holder.

Operation of the copying apparatus having the above-described construction is as follows. The surface of the image bearing member 1 is uniformly charged by the corona discharger 2. Subsequently, the image of an original (not shown) on the original carriage 4 is illuminated by the illuminating light source 5 and the reflected light image thereof is applied onto the image bearing member 1 by the small-diameter imaging element array 3. An electrostatic latent image thus formed on the image bearing member 1 is developed by the developing device 6. When the developed image on the image bearing member 1 arrives at a transfer station, a transfer medium P is fed from a paper supply station F and transported to the transfer station S by the timing rollers 7 in syncronism with the movement of the developed image. the transfer medium P transported to the transfer station through the transfer medium guide 8 is subjected to transfer corona from the back thereof by the transfer corona discharger 9, whereby the developed image on the image bearing member 1 is transferred to the transfer medium P.

After the image transfer, the transfer medium P is separated from the surface of the image bearing member 1 by separating means (not shown) such as a separating belt and is directed to a fixing device, not shown, along the transfer medium conveyance path 10. The transferred image is fixed on the transfer medium P by the fixing device, whereafter the transfer medium is discharged onto a tray 26 by rollers 25. On the other hand, after the image transfer, the image bearing member 1 is cleaned by the elastic cleaning blade 12 of the cleaning device 11. The blade 12 bears against the image bearing member 1 over the image forming area thereof and scrapes off the residual developer or the like. Designated by 27 is a receiving seat which very lightly bears against the image bearing member 1 to direct to a housing 28 the developer or the like scraped off by the blade 12. Denoted by 29 is a rotatable vane rotated in the direction of arrow b to cause the developer to be compressedly stored in an inner space 31 partitioned by a partition plate 30 in the housing 28. The image bearing member is not limited to one having a photosensitive medium, but may also be one having an insulator or the like, for example, and the shape of the image bearing member is neither limited to the drum-like shape, but may also be a belt-like shape or the like.

Figure 2:
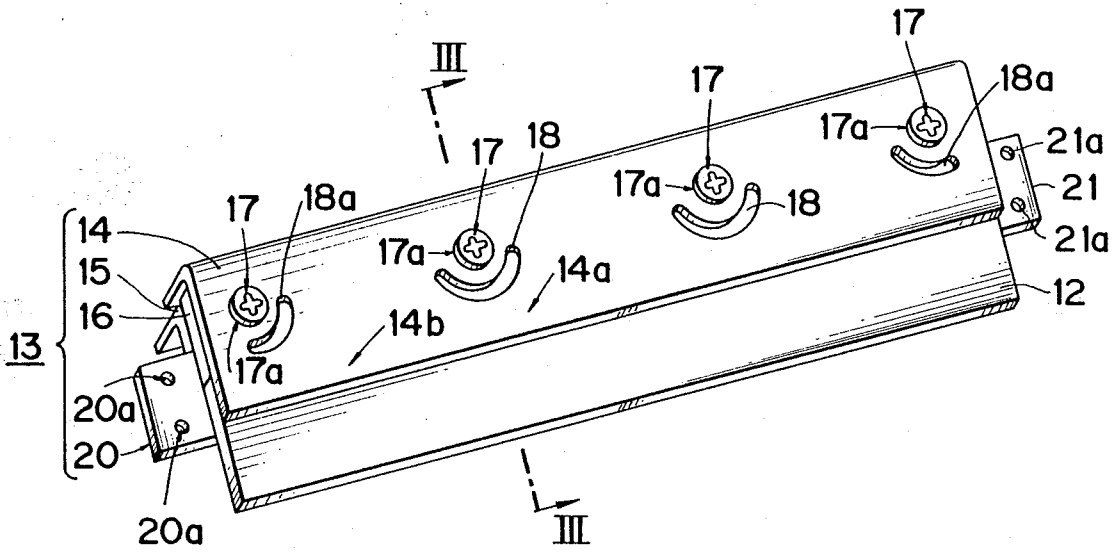
FIG. 2 is a perspective view of the holder portion of a specific example of the device of the present invention.
Figure 3:
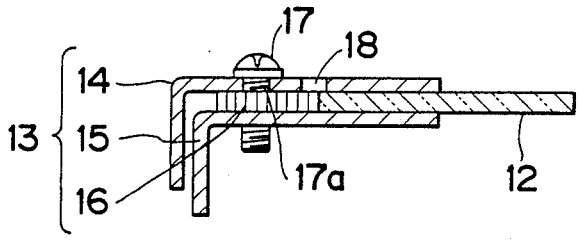
FIG. 3 is a cross-sectional view taken along line III—III of FIG. 2.

FIG. 2 is a perspective view of the elastic cleaning blade and the holder portion of the cleaning device to which an embodiment of the present invention is applied, and FIG. 3 is a cross-sectional view taken along the line III—III of FIG. 2.

The blade holder 13 sandwiching the elastic cleaning blade 12 has a pair of plate-like sandwiching members 14 and 15 supporting the blade 12 from the front and back sides thereof, and a spacer 16 sandwiched between the sandwiching members 14 and 15 and having a slightly smaller thickness than the blade 12. In the sandwiching member 14, buffer portions 18 and 18*a* are provided adjacent to threaded holes 17*a* through which fastening screws 17 for coupling these sandwiching members together. In the illustrated embodiment, the buffer portions adjacent to the threaded holes 17*a* in the middle of the sandwiching member 14 are in the form of semi-circular through-holes 18 provided around the threaded holes 17*a*, and the buffer portions adjacent to the threaded holes 17*a* in the end portions of the sandwiching member 14 are in the form of ¼-circular through-holes 18*a* provided around the threaded holes. The reason why the buffer portions 18*a* provided in the end portions of the sandwiching member 14 are in the form of ¼-circular through-holes 18*a* is that the propagation of the tightening force relative to the blade 12 is somewhat weaker in the end portions than in the middle. Designated by 20 and 21 are mounting portions formed with threaded holes 20*a* and 21*a* for mounting the holder 13 to the housing 28 of the cleaning device.

The sandwiching member 14 thus provided with the buffer portions is applied to the front side of the blade 12 and the sandwiching member 15 is applied to the back side of the blade 12 so that the spacer 16 and the blade 12 are sandwiched between the sandwiching members 14 and 15, and then these are tightened and coupled together by the screws 17. Thereby the elastic cleaning blade is reliably sandwiched.

Moreover, in the end portions of the sandwiching member 14 which sandwich the elastic cleaning blade 12, the tightening force of the screws 17 is substantially uniformly propagated even through both the portion near the screws (e.g., the portion 14*a*) and the portion far from the screws (e.g., the portion 14*b*) and therefore, a phenomenon such as waving does not occur to the elastic cleaning blade.

This is because the propagation of the tightening stress which is liable to concentrate in the portion 14*a* near the screw-tightened point of the blade sandwiching portion is buffered by the buffer portions 18 and 18*a* provided in the sandwiching member 14 to uniformize the propagation of the tightening force in the portion 14*a* as well as in the portion 14*b* far from the screw-tightened point. That is, non-uniformity of the tightening pressure resulting from the difference in the distance from the tightened portion is eliminated.

Incidentally, in a construction wherein the sandwiching member has no buffer portion as in the prior art, the tightening force differs between the blade sandwiching portion near the tightened point and the blade sandwiching portion far from the tightened point and, where thin sandwiching members, for example, are employed, a phenomenon such as waving occurs to the elastic cleaning blade. Theoretically, even if the blade is sandwiched by sandwiching members and they are coupled together at the screw-tightened point, the force is uniformly dispersed and propagated in the rigid member. However, in the case of a practical rigid material which is not an ideal rigid material, the tightening force differs as described above. To render the waving of the blade negligibly small in practice, a construction in which the sandwiching members are of a sufficiently great thickness and large size has heretofore been requisite.

On the other hand, according to the present invention, non-uniformity of the tightening force in the blade sandwiching portion is substantially eliminated by providing the buffer portions as described above. Where iron plates having, for example, a thickness of the order of 1.2 mm and formed with arcuate through-holes of a width of about 2 mm were employed as the sandwiching members of the above-described device and a cleaning blade of polyurethane rubber (JISA hardness 70°) having a thickness of 2 mm was tightened by screws of a diameter of 3 mm with a torque of 6 kg/cm and sandwiched between the iron plates, the waving could be minimized to 0.2 mm or less in the end portions of the blade. Thus, the blade could display a good cleaning performance. To sandwich a cleaning blade of the same material in the conventional construction to such a degree that there is substantially no influence of the waving on the cleaning, sandwiching members having a thickness of at least 2 mm, preferably 3 mm or so, have been required.

In the illustrated embodiment of the device, the buffer portions extend through the sandwiching member, but alternatively, the buffer portions may be made into the form of grooves to thereby weaken the direct propagation of the tightening force.

Figure 4:
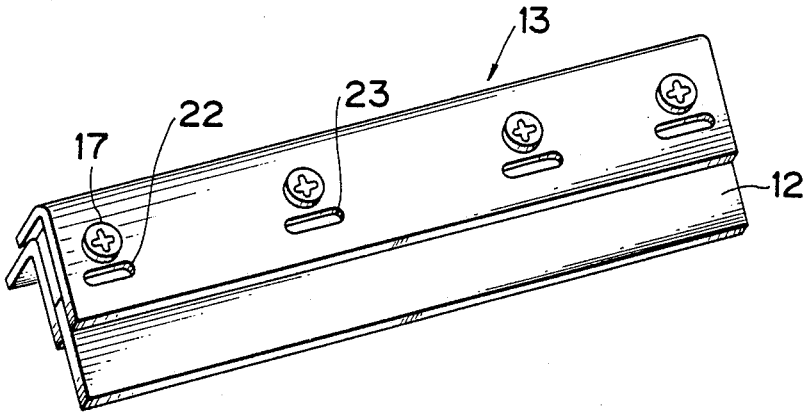
FIG. 4 is a perspective view of the holder portion of the device according to another embodiment of the present invention.

FIG. 4 shows a modification of the present invention. In FIG. 4, members common to those described previously are given similar reference numerals.

In this illustrated example, the buffer portions are in the form of rectangular grooves 22 and 23 instead of arcuate through-holes. Again in this case, the cleaning blade 12 could be held without any waving occurring thereto and could display good cleaning performance.

Also, the above-described embodiment has been shown with respect to a case where buffer portions are provided in one of a pair of sandwiching members, but alternatively, the buffer portions may be provided in both of the two sandwiching members. Also, the buffer portions are not limited in number to one for each tightened portion, but a plurality of such buffer portions may be provided for each tightened portion. The means for coupling the blade and the sandwiching members together is not restricted to screws, but pipets may also be used.

According to the above-described embodiment of the present invention, the phenomenon of waving of the blade can be suppressed within a range which does not hinder the cleaning performance and the blade can be sandwiched between the sandwiching members. This leads to the possibility of making the cleaning device compact and light in weight.

I claim:

1. A cleaning device for cleaning off developing agents from a surface of a rotatable image bearing member, comprising:

an elastic cleaning blade having a free end portion for contacting the image bearing member to clean the same and a sandwiching portion;

first and second sandwiching members for sandwiching said elastic cleaning blade therebetween; and tightening members for tightening said first and second sandwiching members to generate forces on said first and second sandwiching members for sandwiching the sandwiching portion of said elastic cleaning blade;

said first sandwiching member having a buffer portion for each tightening member for buffering partial propagation of tightening force from the respective one of said tightening members, said buffer portions being disposed on said first sandwiching member between a portion thereof tightened by said tightening members and an edge portion of said first sandwiching member near said free end portion of said elastic cleaning blade thereby to render the tightening force across the blade adjacent said edge portion of said sandwiching member more uniform.

2. A cleaning device according to claim 1, wherein each said buffer portion is a portion defining a through hole.

3. A cleaning device according to claim 1, wherein each said buffer portion is a portion defining a groove.

4. A cleaning device according to claim 1, wherein said second sandwiching member also has a respective buffer portion for each said tightening member for buffering the partial propagation of tightening force from the respective one of said tightening members, said buffer portions of said second sandwiching member being disposed on said second sandwiching member between a portion thereof tightened by said tightening members and an edge portion of said second sandwiching member near said free end portion of said elastic cleaning blade.

5. A cleaning device according to claim 1, wherein each said buffer portion is in the form of a circular arc.

6. A cleaning device according to claim 1, wherein one of said buffer portions is located in a central area of said first sandwiching member with respect to a direction defined by the rotation axis of the image bearing member, and wherein said one buffer portion is larger than said buffer portions located near the opposite ends of said first sandwiching member, with respect to said direction.

7. A cleaning device according to claim 6, wherein said central buffer portion is proximate to the associated tightening member.

8. A cleaning device according to claim 1, wherein the tightening forces are provided by tightening screws, wherein said cleaning device is mounted on a casing for storing the developing agents cleaned off from the image bearing member, wherein said mounting is effected at mounting portions of a holder comprising said first and second sandwiching members for said cleaning blade, and wherein said mounting portions extend from opposite side ends of said elastic cleaning blade for attachment to said casing by screws different from said tightening screws.

9. A cleaning device according to claim 1, wherein said tightening members engage said first and second sandwiching members at locations where said tightening members do not pierce said elastic cleaning blade.

10. A cleaning device according to claim 9, wherein said free end portion of said elastic cleaning blade is in contact with the rotatable image bearing member, said first and second sandwiching members are located downstream of said free end portion with respect to the rotation direction of the image bearing member, and said first sandwiching member having said buffer portions is located downstream of said second sandwiching member, with respect to the direction of rotation of the image bearing member.

11. A cleaning device for removing developing agents adhered on a rotatable image bearing member therefrom, comprising:

an elastic cleaning blade for contacting the image bearing member over the whole length thereof in a direction of the rotation axis to remove the developing agents from the image bearing member;

a holder for pressure-pinching said elastic cleaning blade with pressure;

tightening means for providing said holder with the pressure for pressure-pinching said elastic cleaning blade without piercing the same, said tightening means having a plurality of tightening members acting on said holder at individual positions thereon along a longitudinal direction of said elastic cleaning blade; and buffer portions for respective ones of said tightening members, each said buffer portion being provided for buffering a tightening force from the respective one of said tightening members, and being provided between the respective tightening member and an edge of said holder adjacent a cleaning edge of said elastic cleaning blade thereby to render the tightening force across the blade adjacent said edge of said holder more uniform.

12. A cleaning device according to claim 11, wherein said holder comprises a first plate member having said buffer portions, a second plate member separate from and facing said first plate member, and spacer means for forming a space for holding said elastic cleaning blade between said first and second plate members, said spacer means being located at areas where said tightening members apply the tightening forces to form a space at said areas of thickness less than the thickness of said elastic cleaning blade.

13. A cleaning device according to claim 12, wherein said spacer means is a spacer thinner than said elastic cleaning blade and disposed between yet separate from said first and second plate members.

14. A cleaning device according to claim 13, wherein each said buffer portion is a portion defining either a hole or a groove surrounding a respective said tightening member.

15. A cleaning device according to claim 11, wherein a tip edge of said elastic cleaning blade is located upstream of said holder with respect to the rotation direction of the image bearing member and is in contact with the surface of the image bearing member, and wherein said buffer portions are located at a face of said holder near said tip edge of said elastic cleaning blade.

16. A cleaning device according to claim 11, wherein said holder has an L-shaped first plate member having said buffer portions and a second plate member facing said first plate member, and wherein said elastic cleaning blade is held between said first and second plate members with pinching forces provided by said tightening members.

17. A cleaning device according to claim 16, wherein said holder has a spacer separate from said first and second plate members therebetween, said spacer having a thickness less than the thickness of said elastic cleaning blade.

18. A cleaning device according to claim 11, wherein said holder pinches and holds said elastic cleaning blade with pressure at a portion thereof between an edge near the cleaning end of said elastic cleaning blade and said buffer portions.

19. A cleaning device for cleaning off developing agents from a surface of an image bearing member, comprising:

an elastic cleaning blade having a free end portion for cleaning and contacting the image bearing member and a sandwiching portion;

first and second sandwiching members for sandwiching said elastic cleaning blade therebetween; and tightening members for tightening said first and second sandwiching members to generate forces on said first and second sandwiching members for sandwiching the sandwiching portion of said elastic cleaning blade;

said first sandwiching member having a buffer portion for each tightening member for buffering partial propagation of tightening force from the respective one of said tightening members, said buffer portions being disposed on said first sandwiching member between a portion thereof tightened by said tightening members and an edge portion of said first sandwiching member near said free end portion of said elastic cleaning blade thereby to render the tightening force across the blade adjacent said edge portion of said first sandwiching member more uniform;

wherein said free end portion has a cleaning edge contacting the surface of the image bearing member for cleaning off the developing agents remaining on the image bearing member and said first and second sandwiching members are positioned downstream of said cleaning edge with respect to the rotation direction of the image bearing member; and wherein said first sandwiching member is an L-shaped plate member, one face of which closely contacts a face of said elastic cleaning blade forming said cleaning edge, and said tightening members are arranged so as not to pierce said elastic cleaning blade.

20. A cleaning device according to claim 19, further comprising a spacer separate from and between said first and second sandwiching members, said spacer having a thickness less than the thickness of said elastic cleaning blade.

21. A cleaning device according to claim 20, wherein said tightening forces are provided by tightening screws, wherein said cleaning device is mounted on a casing for storing the developing agents cleaned off from the image bearing member, said mounting being effected by mounting portions of a holder comprising said first and second sandwiching members for the cleaning blade, wherein said mounting portions extend from opposite side ends of said elastic cleaning blade for attachment to said casing by screws different from said tightening screws, and wherein the image bearing member is an electrophotosensitive drum.

22. A cleaning device for removing developing agents adhered on a rotatable image bearing member therefrom, comprising:

an elastic cleaning blade for contacting the image bearing member over the whole length thereof in a direction of the rotation axis to remove the developing agents from the image bearing member;

a holder for pressure-pinching said elastic cleaning blade with pressure;

tightening means for providing said holder with the pressure for pressure-pinching said elastic cleaning blade without piercing the same, said tightening means having a plurality of tightening members acting on said holder at individual positions thereon along a longitudinal direction of said elastic cleaning blade; and buffer portions for respective ones of said tightening members, each said buffer portion being provided for buffering a tightening force from the respective one of said tightening members, and being provided between the respective tightening member and an edge of said holder adjacent a cleaning edge of said elastic cleaning blade thereby to render the tightening force across the blade adjacent said edge of said holder more uniform, wherein the ones of said buffer portions disposed at both end areas of said cleaning device with respect to the direction of the rotation axis of the image bearing member are smaller than one said buffer portion disposed at a central area thereof.

23. A cleaning device for removing developing agents adhered on a rotatable image bearing member therefrom, comprising:

an elastic cleaning blade for contacting the image bearing member over the whole length thereof in a direction of the rotation axis to remove the developing agents from the image bearing member;

a holder for pressure-pinching said elastic cleaning blade with pressure;

tightening means for providing said holder with the pressure for pressure-pinching said elastic cleaning blade without piercing the same, said tightening means having a plurality of tightening members acting on said holder at individual positions thereon along a longitudinal direction of said elastic cleaning blade; and buffer portions for respective ones of said tightening members, each said buffer portion being provided for buffering a tightening force from the respective one of said tightening members, and being provided between the respective tightening member and an edge of said holder adjacent a cleaning edge of said elastic cleaning blade thereby to render the tightening force across the blade adjacent said edge of said holder more uniform, wherein each said buffer portion is a portion defining either a hole or a groove surrounding a respective said tightening member.

24. A cleaning device according to claim 23, wherein said holder comprises a first plate member having said buffer portions, a second plate member separate from and facing said first plate member, and spacer means for forming a space for holding said elastic cleaning blade between said first and second plate members, said spacer means being located at areas where said tightening members apply the tightening forces to form a space at said areas of thickness less than the thickness of said elastic cleaning blade.

25. A cleaning device according to claim 24, wherein said spacer means is a spacer thinner than said elastic cleaning blade and disposed between, yet separate from, said first and second plate members.

26. A cleaning device according to claim 23, wherein a tip edge of said elastic cleaning blade is located upstream of said holder with respect to the rotation direction of the image bearing member and is in contact with the surface of the image bearing member, and wherein said buffer portions are located at a face of said holder near said tip edge of said elastic cleaning blade.

27. A cleaning device according to claim 23, wherein said holder has an L-shaped first plate member having said buffer portions and a second plate member facing said first plate member, and wherein said elastic cleaning blade is held between said first and second plate members with pinching forces provided by said tightening member.

28. A cleaning device according to claim 27, wherein said holder has a spacer separate from said first and second plate members therebetween, said spacer having a thickness less than the thickness of said elastic cleaning blade.

29. A cleaning device according to claim 23, wherein said holder pinches and holds said elastic cleaning blade with pressure at a portion thereof between an edge near the cleaning end of said elastic cleaning blade and said buffer portions.

* * * * *